United States Patent [19]

Gross

[11] 3,979,156

[45] Sept. 7, 1976

[54] DECORATIVE AUXILIARY TRANSPARENT TABLE TOP UNIT FOR TABLES, DESKS, AND THE LIKE

[76] Inventor: Henry Gross, 1715 Ave. X, Brooklyn, N.Y. 11235

[22] Filed: May 6, 1975

[21] Appl. No.: 575,012

[52] U.S. Cl. ..... 312/196; 108/91; 312/140.1

[51] Int. Cl.[2] ..... A47F 9/00; A47B 87/00

[58] Field of Search ..... 108/90, 91; 312/140, 312/140.1, 140.4, 204, 196, 241

[56] References Cited

UNITED STATES PATENTS

| | | | |
|---|---|---|---|
| 161,502 | 3/1875 | Gilbert | 108/90 |
| 1,259,970 | 3/1918 | Elliott | 312/140.1 |
| 2,098,453 | 11/1937 | James et al. | 312/140.1 |
| 2,935,205 | 5/1960 | Higgin | 108/91 |
| 3,125,385 | 3/1964 | Friedman | 312/223 |

*Primary Examiner*—Casmir A. Nunberg
*Attorney, Agent, or Firm*—Friedman & Goodman

[57] ABSTRACT

A decorative auxiliary table top unit for a table, desk and the like, the unit comprising a transparent table top member and vertical members for supporting the table top member above the table, desk and the like to define a compartment space therebetween to receive articles of food, writing material and the like which can be seen through an upper surface of the transparent table top member. The vertical support members are disposed around the periphery of the table top member and are spaced apart to permit horizontal access to the compartment space. An edge member is disposed around the periphery of the table between the support members and an undersurface of the table top member, where upper portions of the support members are secured to the edge member, and lower portions of the support members are secured to the table, desk and the like for maintaining the table top member in its elevated position. Additionally, transparent extension members are provided for enlarging the table top unit, where the extension members are held in position by latching members which engage associated support members.

7 Claims, 12 Drawing Figures

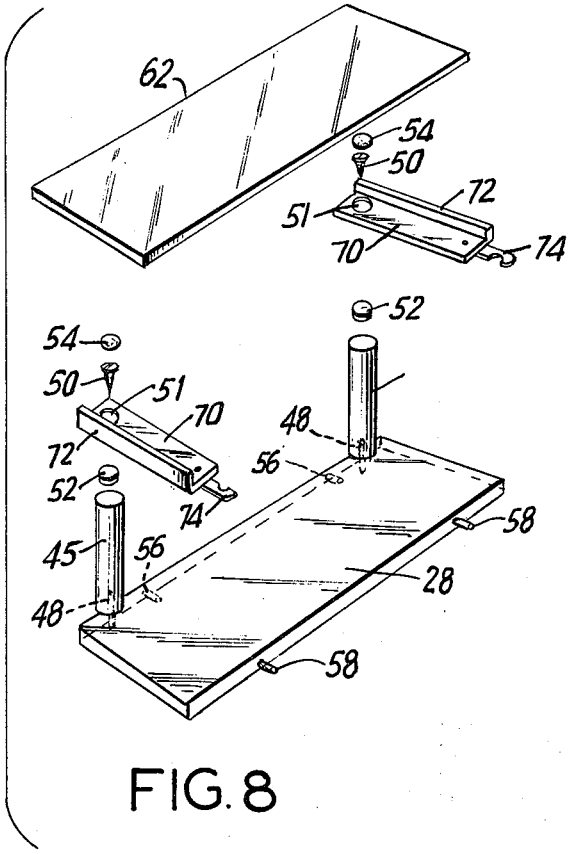
FIG. 8
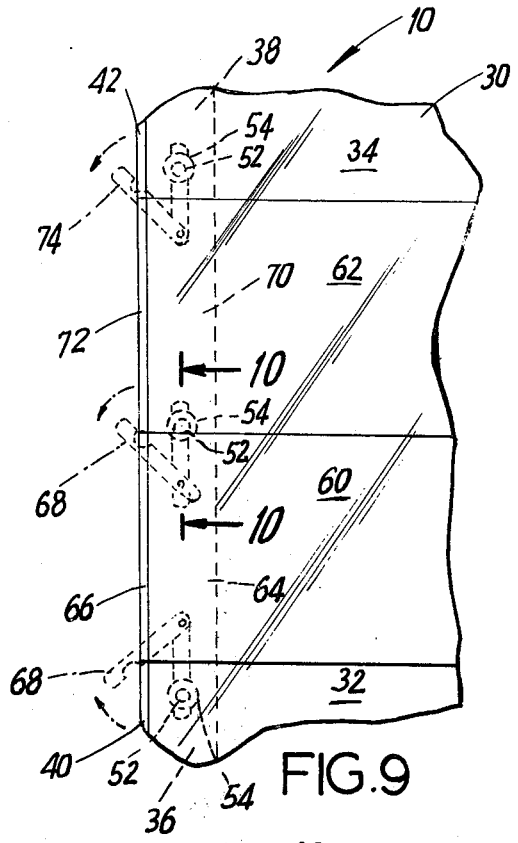
FIG. 9
FIG. 10
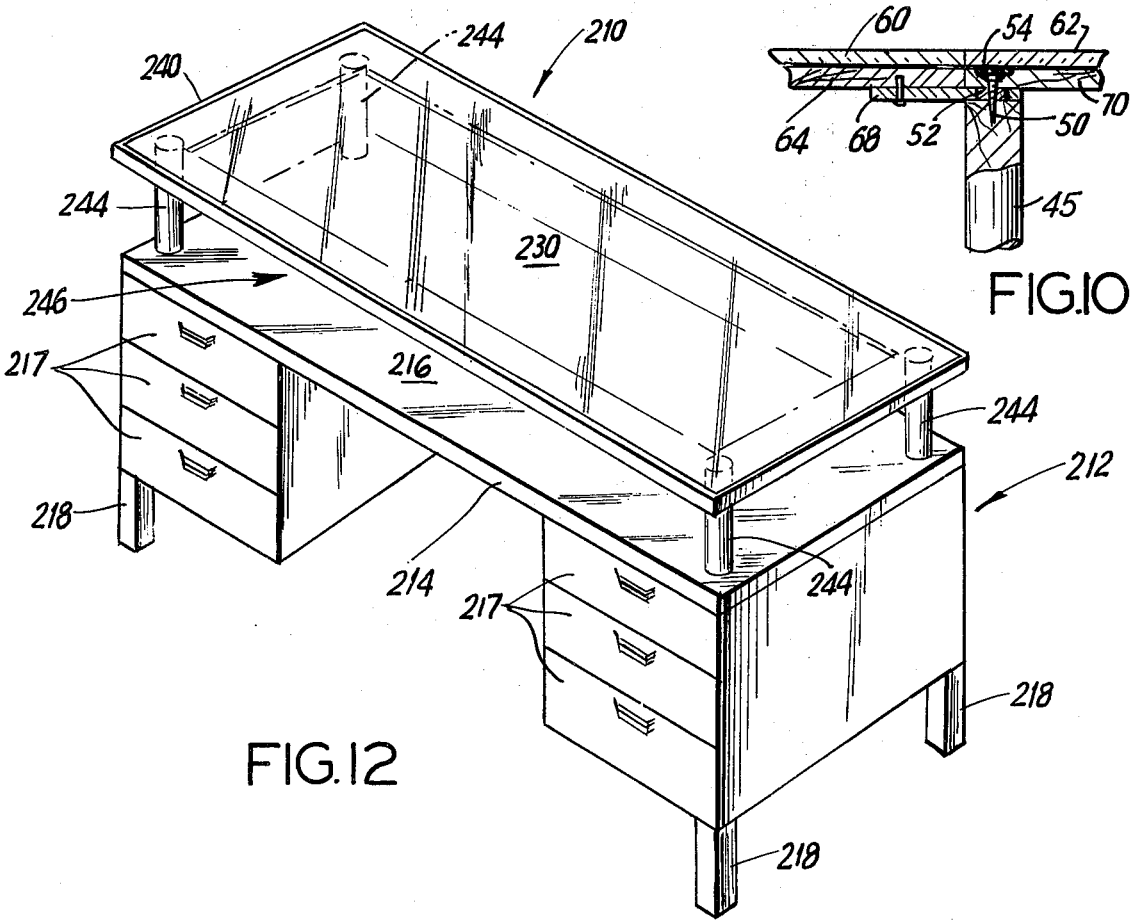
FIG. 12

DECORATIVE AUXILIARY TRANSPARENT TABLE TOP UNIT FOR TABLES, DESKS, AND THE LIKE

BACKGROUND OF THE INVENTION

The present invention relates generally to an auxiliary table top unit, and more particularly to a decorative auxiliary transparent table top member adapted to be supported and spaced above the top surface of a table, desk and the like.

Most tables, desks and the like provide limited top surfaces upon which food, writing material and the like can be placed. This problem is more evident when the size of the table or desk may be small due to the size of the room in which it is located. Occasionally, additional serving tables or work tables must be provided in order to accommodate a large amount of food, articles of writing material. Additionally, a large amount of articles on the table or desk tend to interfere with the person seated thereat, particularly when the person is eating, playing cards or working. Furthermore, there is no adequate place to store these articles prior to being used, where these articles may be forgotten if placed out of the person's sight, or beyond the person's reach.

Heretofore in the prior art, where a person has desired the convenience and enjoyment of a large table, it has been necessary to purchase or acquire such a table or a smaller table provided with extension leafs. However, the problem is even more accentuated in the case of persons who reside in either apartments or condominium type units, since usually space is simply not available to permit the installation of a large table, or to permit an extension table to be expanded to its full size having all its leafs therein. However, even tables that are designed to be small create problems, for example game tables, where the players usually have refreshments while playing the game, such refreshments usually interfering with the play of the game where they can be easily spilled over the table.

SUMMARY OF THE INVENTION

Accordingly, it is an object of the present invention to provide a decorative auxiliary table top unit for a table, desk and the like which overcomes the disadvantages of the prior art.

It is another object of the present invention to provide a decorative auxiliary table top unit that may be supported above a table, desk and the like to provide a compartment space therebetween for receiving articles of food, writing material and the like.

It is a further object of the present invention to provide a table top unit as mentioned above having a transparent table top member so that articles placed in the compartment space can be seen through the upper surface of the table top member.

It is a still further object of the present invention to provide a table top unit as mentioned above having spaced apart support members to permit horizontal access to the compartment space.

It is an added object of the present invention to provide a table top unit as mentioned above having extension members to permit enlargement thereof.

And yet another added object of the present invention is to provide a table top unit as mentioned above that can easily be mounted and secured to the upper surface of a table, desk and the like to provide an auxiliary surface therefor.

To this end, the present invention relates to a decorative auxiliary table top unit for a table, desk and the like, the unit comprising a transparent planar table top member and vertical means for supporting the table top member above a top surface of the table, desk and the like to define a compartment space therebetween for receiving articles of food, writing material and the like which can be seen through an upper surface of the transparent table top member. The vertical means include a plurality of support members disposed around the periphery of the table top member, the support members being spaced apart to permit horizontal access to the compartment space. An edge member is disposed around the periphery of the table top member, being secured to the support members. Extension members are provided to enlarge the table top unit. Preferably, the extension members are secured to the support members by latching means.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIGS. 7 and 8 illustrates an exploded view of the extension members shown in FIGS. 3 and 4;

FIG. 9 illustrates a fragmentary enlarged top plan view of the extension members shown in FIG. 4;

FIG. 10 illustrates an enlarged cross sectional view taken along the line 10—10 in FIG. 9;

FIG. 12 illustrates a perspective view of a further modified table top unit according to the present invention, mounted on a desk.

DETAILED DESCRIPTION OF THE PREFERRED EMBODIMENT

Figure 1:
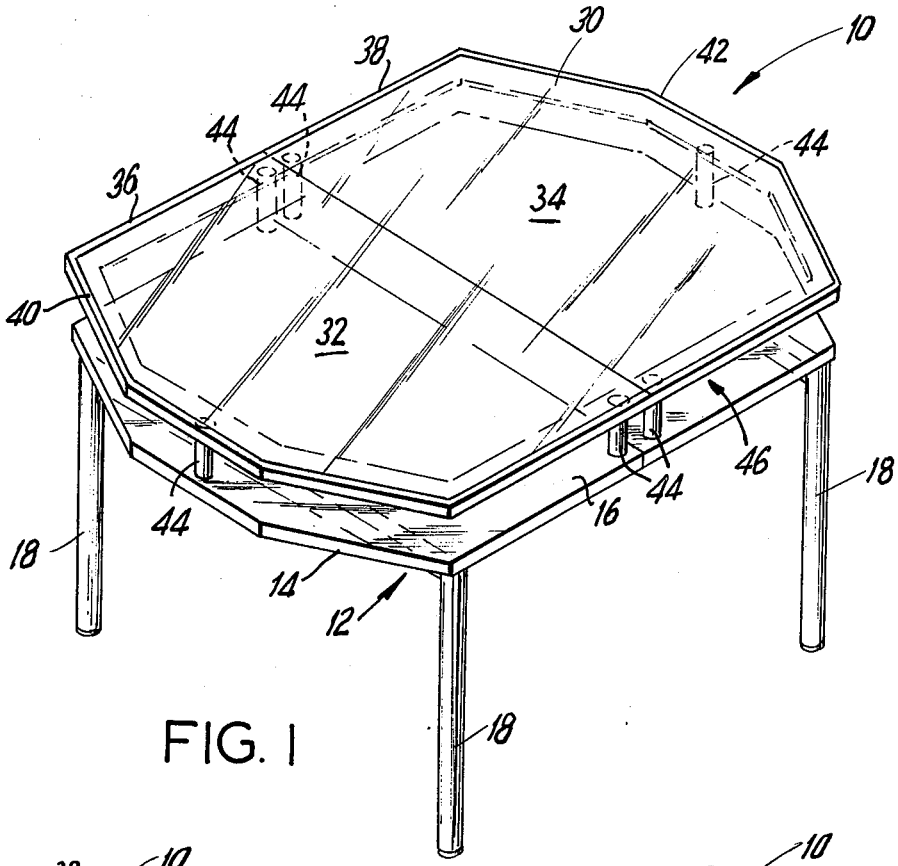
FIG. 1 illustrates a perspective view of a decorative auxiliary transparent table top unit according to the present invention, mounted on a dining room-type table.
Figure 2:
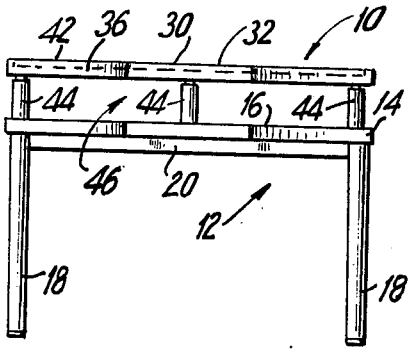
FIG. 2 illustrates an end elevational view of the table shown in FIG. 1.
Figure 3:
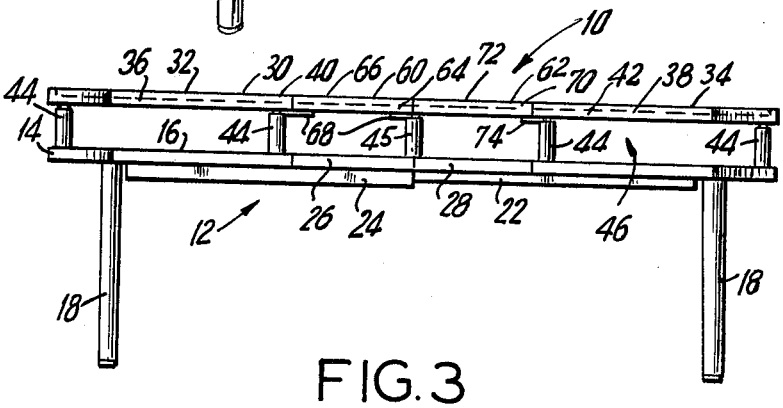
FIG. 3 illustrates a side elevational view of the table of FIG. 1, shown in an expanded arrangement.
Figure 4:
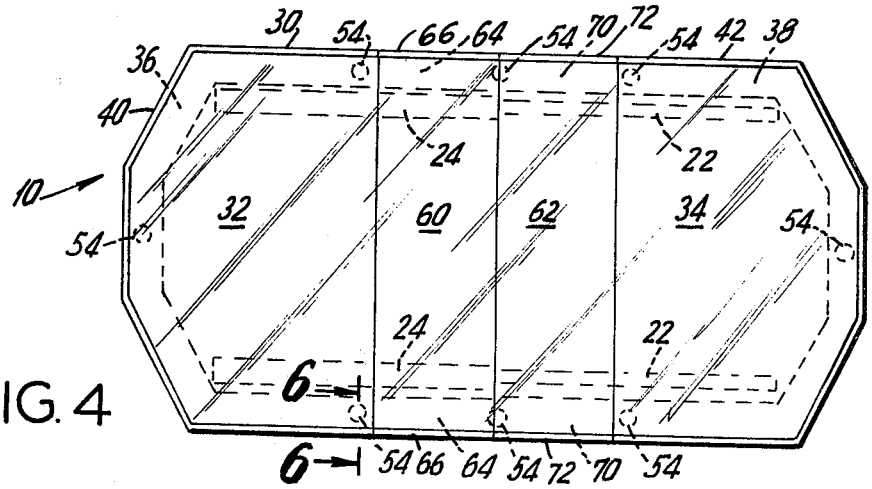
FIG. 4 illustrates a top plan view of the table of FIG. 3.

Referring now to the drawings, and more specifically to FIG. 1 thereof, the present invention comprises a decorative auxiliary table top unit generally denoted by the reference character 10. The table unit 10 is mounted on a conventional wood or metal table 12 having a conventional table top 14 provided with a planar top opaque surface 16 and four table legs 18. As shown in FIG. 2, a conventional bracket 20 secures the legs 18. As shown in FIGS. 3 and 4, a conventional pair of telescoping expansion bars, bar 22 being adapted to slide into bar 24, are shown to permit the table 12 to be expanded and receive conventional expansion leafs 26 and 28. The table 14 is shown for illustrative purposes only, where any conventional table such as a living room-type table may be adapted by the present invention as hereinafter described.

The table top unit 10 includes a table top member 30, which is preferably divided in half to form sections 32 and 34. The half sections 32 and 34 are fabricated from a transparent material, such as glass, plexiglass or any other similar transparent plastic. Edge members 36 and 38 are disposed around the peripheral portions of the transparent sections 32, 34 respectfully, being positioned against the undersurfaces thereof. The edge members 36, 38 are provided with vertically extending lips 40 and 42 respectively for abutting and enclosing the peripheral edges of the transparent sections 32, 34. The edge members 36, 38 are preferably fabricated from a decorative wood or metal such as aluminum or chrome, where the lip portions 40, 42 extend upwardly to a height equal to the top surface of the sections 32, 34 to be level therewith, as best shown in FIG. 6.

A plurality of support members or posts 44 support the table top member 30 above the top surface 16 of the table 12 to provide a compartment or storage spapce 46 therebetween. The support members 44 are disposed between the peripheral edge portions of the table top member 30 and the table top 14. Preferably, as shown in FIG. 1, three support members 44 are provided for each of the half sections 32 and 34, however, the number of support members may vary according to the particular design of the table top unit 10 which is made to match the contour of the conventional table top 14. As shown, the table top member 30 has straight sides and three substantially equal straight portions forming each end thereof, where the intermediate end portion is perpendicular to the sides and the remaining end portions are disposed at angles therebetween, so that the table top member 30 and the edge members 36, 38 thereon conform to the configuration of the table top 14.

Figure 5:
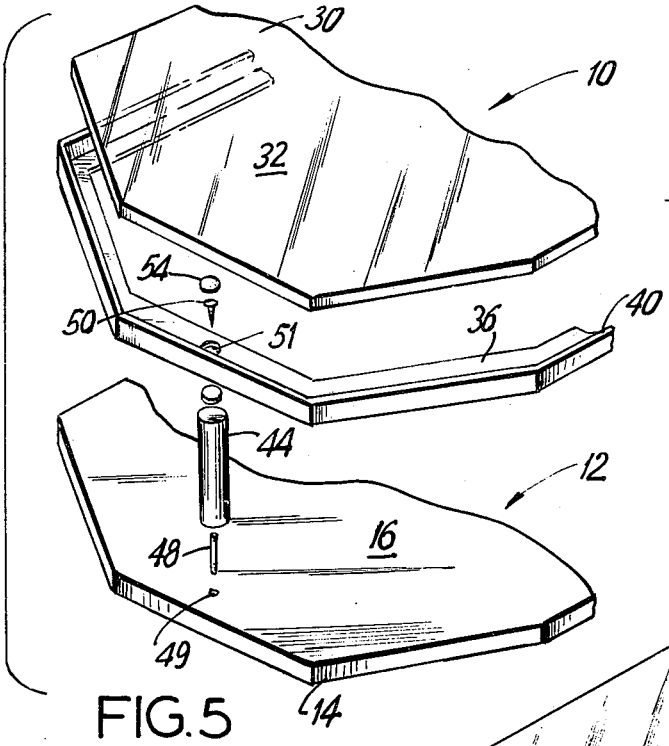
FIG. 5 illustrates a fragmented exploded view of the end portion of the table of FIG. 1.
Figure 6:
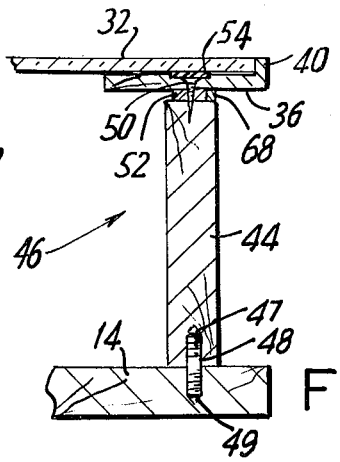
FIG. 6 illustrates an enlarged cross sectional view taken along the line 6—6 in FIG. 4.

As best shown in FIGS. 5 and 6, the support members 44 are secured to the table top 14 by conventional threaded members 48. The threaded members 48 are threaded at both ends to be received in threaded openings 49, 47 in both the table top 14 and the support members 44 in a conventional manner well known in the art. A conventional screw or bolt 50 provided with an enlarged head is inserted through a countersunk opening 51 provided in the edge members 36, 38 to secure the edge members 36, 38 to the support members 44. Preferably, a washer or spacer 52 is disposed on the screw members 50 between the edge members 36, 38 and the support members 44 for reasons which will be discussed hereinafter below.

Additionally, a pad 54 is disposed in each of the countersunk openings 51 above the head of the screw 50. In addition to concealing the screw 50, the pad 54 is fabricated from rubber, plastic, felt or similar material to provide a cushioning effect for the table top member 30 which rests thereon. Furthermore, the upper surface of the pad 54 is colored the same as the edge members 36, 38 to blend therewith and conceal tthe openings 51. It is desired that the upper surface of the pad 54 also have adhesive-like characteristics to prevent the table top member 30 from sliding thereon, thereby maintaining the table top member 30 in a fixed position.

After the support members 44, with the edge members 36, 38 secured thereon, are secured to the table top 14, the half sections 32, 34 are inserted into the edge members 36, 38 respectively. The lip portions 40, 42 and the pads 54 hold the half sections 32, 34 in place so that there is no horizontal movement thereof. If desired, a clear adhesive of any type well known in the art can be applied to the upper surface of the edge members 36, 38 to further secure the transparent half sections 32, 34 to the edge members 36, 38 respctfully.

Thus from the above assembly, the table shown in FIG. 1 is constructed. Accordingly, the table top 14 is at a proper height to permit a person to sit at the table with his knees thereunder, while enjoying a meal or dinner placed on the table top member 30. Additionally, articles of food can be placed on the table top 14 in the compartment space 46 provided therefor, where the articles of food are easily placed therein between the support members 44, and can easily be reached. Advantageously, the stored articles of food can be seen through the tranparent top member 30, so that the person eating can easily select the next article of food he desires. This arrangement allows the person to enjoy his meal in comfort, having plenty of room on the table top member 30 which is uncluttered by unnecessary articles. The compartment space 46 can also be used for the storage of plates which are to be cleared after the meal. The improved table of the present invention lends itself for use in restaurants where space is at a premium.

The present invention also makes provision for the table to be expanded. The table 12 is expanded in the conventional manner by placing either one, two or more conventional expansion leafs 26, 28 thereon, where the expansion leafs are provided with the conventional holes 56 and pegs 58 for securement thereof, and rests on the bars 22, 24.

Figure 7:
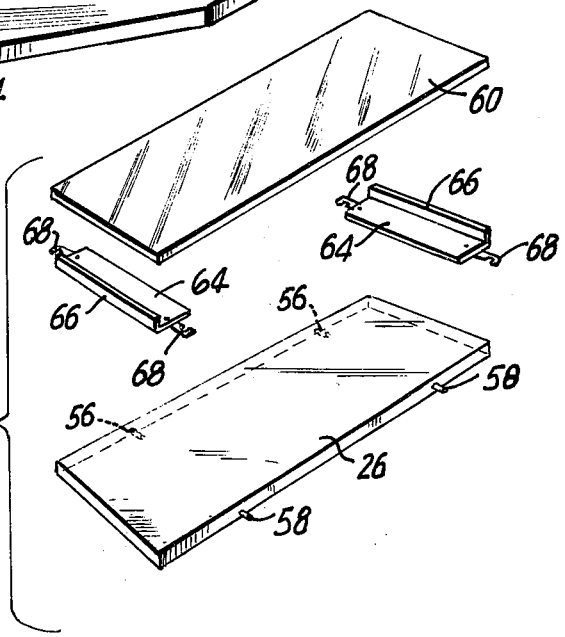

As shown in FIGS. 7 and 8, a transparent expansion section 60 is associated with the leaf 26, and a transparent expansion section 62 is associated with the expansion leaf 28. A pair of section edge members 64 having vertically lip portions 66 thereon are associated with the expansion section 60. Each of the section edge members 64 is provided with a pair of latching members 68 disposed at each end thereof, being rotatably secured under the extension edge member 64 by conventional pins. screws or rivets.

Accordingly, if it is desired to add one leaf, the table is expanded and the expansion leaf 26 is inserted in the conventional manner. The expansion edge members 64 are then secured to the associated center support members 44 by the latch members 68, where the opening in the latch members 68 hook into the spacer 52, as shown in FIG. 6 and indicated in FIG. 10. Thus, the section edge members 64 are secured in place between the central support members 44, and the expansion section member 60 is then places down on the section edge members 64 so that it is positioned between the lip portions 66 which serve to hold the expansion section member 60 in place to prevent horizontal movement thereof.

If additional expansion of a table is desired, the expansion section 62 is added. A pair of expansion edge members 70 are associated with the expansion section member 62. The expansion edge members 70 are provided with vertically extending lip portions 72. The above-mentioned countersunk holes 51 are provided at one end of the expansion edge member 70, and a latch member 74 similar to the latches mentioned above is provided at the opposite end thereof, being riveted or pinned for rotation thereof to the underside of the expansion edge member 70. A pair of support members or posts 45, similar to support members 44, are secured to the expansion leaf 28 by the threaded members 48 in a similar manner as mentioned above, the support members 45 being disposed near the edge portions of the expansion leaf 28. One end of the expansion edge members 70 is then secured to the support member 45 using the above-mentioned screws 50, where the washers or spacers 52 are disposed on the screws 50 between the support members 45 and the expansion edge member 70. Additionally, the pads 54 are placed in the opening 51 above the heads of the screws 50, in a manner mentioned above.

Accordingly, if it is desired to add an additional leaf, the table is expanded and the expansion leaf 28, with the support members 45 and expansion edge members 70 mounted thereon, is inserted in the conventional manner between the expansion leaf 26 and table top 14. The expansion edge members 70 are then secured to the associated center support members 44 at one end thereof by the latch members 74, where the openings in the latch members 74 hook onto the spaces 52, as shown in FIG. 9. Additionally, one end of each of the edge members 64 is secured to the support member 45 by the latch members 68, where the opening in the latch members 68 hook onto the spacer 52, as shown in FIG. 10.

However, in some cases the support members 45 are not spaced the same distance from the latch members 68 as the support members 44 are spaced thereto. Accordingly, the position of the hook openings in the latch members 68 must be relocated. This may be accomplished by many methods well known in the art, such as providing slots in the latch members 68 for association with the pins pivotting same, or by relocating the pin or screw in the latch members 68 to bring the hook opening in the latch members 68 closer to the pivot point, as shown in FIG. 9.

Thus, each of the section edge members 64, 70 are secured in place between the central support members 44 and the support members 45. The expansion section member 60 which has been removed during this above-mentioned assembly, is now replaced down on the section edge members 64, and the expansion section member 62 is placed down on the section edge members 70, so that each is positioned between their respective lip portions 66, 72 which serve to hold the expansion section members in place to prevent horizontal movement thereof, as best shown in FIGS. 3 and 4.

Figure 11:
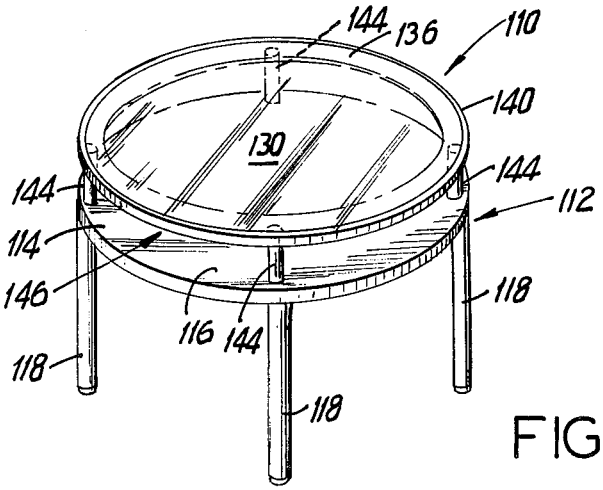
FIG. 11 illustrates a perspective view of a modified table top unit according to the present invention, mounted on a game table.

FIG. 11 shows a modified decorative auxiliary circular table top unit 110 mounted on a conventional wood or metal table 112, such as a circular card table. The card table is provided with a conventional table top 114 having a planar top opaque surface 116 and four table legs 118.

The table top unit 110 includes a transparent circular tagle member 130, and circular edge member 136 having a vertically extending lip portion 140, and support members 144. The table top unit 110 is assembled in a similar manner as mentioned above to provide a compartment or storage space 146.

Thus, as mentioned above, the table top 114 is at a proper height to permit a person to sit at the table with his knees thereunder, while playing a game such as cards on the table top member 130. Articles of food or refreshments can be placed on the table top 114 in the compartment space 146 provided therefor, where such articles do not interfere with the playing of the game, the articles being easily placed therein between the support members 144, and can easily be reached. Advantageously, the articles can be seen through the transparent top member 130 so that a person playing the game can easily select a desired article, such as ashtrays, glasses, coffee cups, etc.

FIG. 12 shows a modified decorative auxiliary square table top or desk unit 210 mounted on a conventional wood or metal desk 212. The desk 212 is provided with a square conventional top 214 having a planar top opaque surface 216, conventional draws 217 and four desk legs 218.

The table top unit 210 includes a square transparent table top or desk member 230, and square edge member 236 having a vertically extending lip portion 240, and support members 244. The table top unit 210 is assembled in a similar manner as mentioned above to provide a compartment or storage space 246.

Thus, as mentioned above, the desk top 214 is at a proper height to admit a person to sit at the desk with his knees thereunder, while doing his required work, the work being disposed on the table or desk top member 230. Articles such as reference books or notes can be placed on the desk top 214 in the compartment space 246 provided therefor, where such articles or written material do not interfere with the working person, the articles being easily placed therein between the support member 244, and can easily be reached. Advantageously, the articles can be seen through the transparent top member 230 so that a person working at the desk can easily select a desired article.

Numerous alternations of the stucture herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A decorative auxiliary table top unit for a table, desk and the like, said unit comprising a transparent planar table top member, vertical means disposed below an undersurface of said table top member for supporting said table top member above a top surface of the table, desk and the like to define a compartment space between said undersurface of said top member and the top surface of the table, desk and the like for receiving articles of food, writing material and the like which can be seen through an upper surface of said transparent table top member, said vertical means including a plurality of support members disposed under said table top member, said support members being spaced apart to permit horizontal access to said compartment space, first means securing said support members to the table, desk and the like, second means for maintaining said table top member stationary relative to said support members, said second means including an edge member disposed around periphery of said table top member, said edge member being disposed against said undersurface of said table top member, said support members being disposed against said edge member, said second means further including fastening means for securing said edge member to said support members, said edge member being provided with vertically extending lip means engaging peripheral edge of said table top member for preventing horizontal movement of said table top member.

2. A decorative auxiliary table top unit as claimed in claim 1, wherein said fastening means are countersunk below upper surface of said edge member, and cushioning means are disposed in said edge member above said fastening means for engagement with said undersurface of said table top member for preventing horizontal movement of said table top member.

3. A decorative auxiliary table top unit for a table, desk and the like, said unit comprising a transparent planar table top member, vertical means disposed below an undersurface of said table top member for supporting said table top member above a top surface of the table, desk and the like to define a compartment space between said undersurface of said top member and the top surface of the table, desk and the like for receiving articles of food, writing material and the like which can be seen through an upper surface of said transparent table top member, said vertical means including a plurality of support members under said table top member, said support member being spaced apart to permit horizontal access to said compartment space, first means securing said support members to the table, desk and the like, second means for maintaining said table top member stationary relative to said support members, said table top member including a first half transparent member separatable from a second half transparent member and at least one transparent extension member disposed between said first and second half members to define an enlarged table top unit, said third means for supporting said extension member relative to said first and second half members.

4. A decorative auxiliary table top unit as claimed in claim 3, wherein said second means includes edge members disposed around periphery of said table top member on said extension member and said first and second half members against the undersurface thereof.

5. A decorative auxiliary table top unit as claimed in claim 4, wherein said edge members are provided with vertically extending lip means engaging peripheral edges of said extension member and said first and second half members for preventing horizontal movement of said extension members and said first and second half members.

6. A decorative auxiliary table top unit as claimed in claim 4, wherein said third means includes latch members connecting said edge members of said extension member to adjacent associated ones of said support members.

7. A decorative auxiliary table top unit as claimed in claim 3, wherein additional transparent extension members are disposed between said first and second half members to define a further enlarged table top unit, said vertical means including at least two of said support members being disposed below at least one of said additional extension members for supporting said one additional extension member.

* * * * *